US006583749B2

(12) United States Patent
Aknin

(10) Patent No.: US 6,583,749 B2
(45) Date of Patent: Jun. 24, 2003

(54) ANTIDETECTION BY RADAR DEVICE FOR A FLATTENED SUPERSTRUCTURE OF A SHIP

(75) Inventor: Bernard Aknin, Antony (FR)

(73) Assignee: MBDAM, Paris (FR)

( * ) Notice: Subject to any disclaimer, the term of this patent is extended or adjusted under 35 U.S.C. 154(b) by 0 days.

(21) Appl. No.: 10/106,320

(22) Filed: Mar. 27, 2002

(65) Prior Publication Data

US 2003/0011504 A1 Jan. 16, 2003

(30) Foreign Application Priority Data

Mar. 30, 2001 (FR) ..... 01 04320

(51) Int. Cl.[7] ..... H01Q 17/00
(52) U.S. Cl. ..... 342/2; 342/1; 342/5; 342/13
(58) Field of Search ..... 342/1, 2, 4, 5, 342/7, 12, 13–20

(56) References Cited

U.S. PATENT DOCUMENTS 3,806,927 A * 4/1974 Lane, Jr. ..... 342/7
4,323,605 A 4/1982 Rush ..... 428/17
4,990,918 A * 2/1991 Michelson et al. ..... 342/7
5,121,122 A * 6/1992 Frye ..... 342/1
5,276,447 A * 1/1994 Shingo ..... 342/2
6,060,411 A * 5/2000 Cline et al. ..... 442/132
6,184,815 B1 * 2/2001 Carlson ..... 342/4
6,252,541 B1 * 6/2001 James ..... 342/165

FOREIGN PATENT DOCUMENTS

WO 0109562 2/2001

OTHER PUBLICATIONS

Mraz S J: "Stealth Stalks the High Seas. The Sea Wraith Combines Several Stealth Technologies with the Latest Advances in Weapon and Hull Design", Machine Design, Penton, Inc. Cleveland, US, vol. 69, No. 10, pp. 40, 42, 44, May 22, 1997.

Database WPI, Section PQ, Week 199835, Derwent Publications Ltd., London, GB; AN 1998–412225, XP002187151 & RU 2 101 658 A (Kovalev), Jan. 10, 1998.

* cited by examiner

*Primary Examiner*—Thomas H. Tarcza
*Assistant Examiner*—Isam Alsomiri
(74) *Attorney, Agent, or Firm*—Stevens, Davis, Miller & Mosher, LLP

(57) ABSTRACT

According to the invention, there is provided a device enveloping said superstructure and able to reflect electromagnetic waves, said device comprising a truncated pyramidal frame (6) and a net (7) covering the small base of said frame (6).

9 Claims, 6 Drawing Sheets

ANTIDETECTION BY RADAR DEVICE FOR A FLATTENED SUPERSTRUCTURE OF A SHIP

FIELD OF THE INVENTION

The present invention relates to an antidetection by radar device for a flattened superstructure of a ship.

BACKGROUND OF THE INVENTION

It is known that the weaponry of a combat ship, in addition or instead of the usual guns and torpedos, comprises batteries of anti-ship missiles or of anti-aircraft missiles. These missiles and their launch means can be arranged as a superstructure on the deck of the ship. However, for obvious reasons of detectability by radar, it is preferable for said batteries of missles to be disposed as far as possible inside said ship.

In this case, said missiles can be disposed in vertical shafts disposed under the deck of said ship and occluded at their upper part by swiveling doors which, in the closed position—that is to say when the batteries are idle outside a firing sequence—project slightly with respect to said deck.

When idle, the superstructure of said batteries of missiles therefore comprises said doors in the closed position. It may comprise, moreover, ducts for discharging the combustion gases from the motors of the missiles. In all cases, it is very flattened on the deck, jutting out from the latter by only a small amount. Therefore, the overall radar signature of the ship results mainly from its other superstructures, such as hull, bridge, gangway, masts, antennas, etc.

However, although relatively weak, the radar signature of the superstructure of such a battery of missiles when idle, partially enclosed under the deck, unfavorably influences the overall radar signature of the ship.

SUMMARY OF THE INVENTION

The object of the present invention is therefore to render the upper part of the superstructure of such batteries of missiles when idle stealthy, so that the overall radar signature of the ship is not affected thereby.

To this end, according to the invention, the device enabling a flattened superstructure carried by the deck of a ship to be rendered insusceptible to electro-magnetic waves, in particular the superstructure of an idle battery of missiles onboard a ship and said missiles of which are contained in vertical shafts disposed partially under the deck of said ship and occluded at their upper part by swiveling doors which, in the closed position, constitute said superstructure at least in part, is noteworthy in that it comprises:

- at least on each of the port and starboard sides of said superstructure at least one inclined plane screen able to reflect an incident beam of electromagnetic waves in a different direction from that of said incident beam, said screens projecting with respect to said deck by a height greater than that of said superstructure and the inclination of said screens being such that they get closer to said superstructure as they get further from said deck; and
- a net, reflecting the electromagnetic waves and stretched above said superstructure.

Thus, should a detection radar, disposed laterally with respect to said ship, dispatch an incident beam to said superstructure, it cannot receive the corresponding reflected beam, should said incident beam strike one of said plane screens or said protective net.

It will be noted that, by virtue of the presence of said protective net stretched above the superstructure, the height of said screens may be relatively small. Specifically, the incident radar beams passing above said screens and striking said net are also reflected in a different direction.

Preferably, said protective net is stretched between the free edges, away from said deck, of said inclined plane screens, so that the height of said net above the deck is equal to that of said inclined plane screens.

Thus, said inclined plane screens and said net form an antiradar protective enclosure enveloping said superstructure while rendering it particularly insusceptible.

To further increase this protective effect by envelopment, it is advantageous for the device in accordance with the present invention to comprise, in addition to the port and starboard inclined plane screens, additional similar inclined plane screens forming, with said port and starboard screens a polyhedron surrounding said superstructure, said protective net being stretched between the free edges of all said inclined plane screens.

In an advantageous embodiment of this type, said device comprises four inclined plane screens—including a port screen and a starboard screen—forming a frusto-pyramidal tetrahedron surrounding said superstructure.

Additionally, to prevent such antidetection protection from being an obstacle to the firing of the missiles, matters are contrived such that said height of the inclined plane screens and of said net is less than the length of the swiveling occluding doors and that said protective net can be ripped by each of said doors passing from the closed position to the open position. Thus, simply by opening the doors, the net is ripped and affords free passage opposite said shafts, so that the missiles can be fired instantaneously.

It will be noted that said net must, on the one hand, be able to be easily torn by the doors of the shafts when they open, but, on the other hand, be strong enough to withstand wind and heavy seas. It has been found that it is possible to satisfy these contradictory requirements by making said net with steel wires, the diameter of which is at most equal to 0.4 cm.

It is known, additionally, that detection radars emit beams of electromagnetic waves whose frequency lies between 2 and 18 GHz. It follows that, in order for said net to be able to reflect these electromagnetic waves, the largest dimension of its cells must be at most equal to 0.8 cm. Preferably, a net having square cells with sides most equal to 0.8 cm is chosen.

Additionally, to allow for the roll of the ship, as will be seen hereinbelow, the angle of inclination of said inclined plane screens with respect to the deck of the ship is chosen at most equal to 60°.

BRIEF DESCRIPTION OF THE DRAWINGS

The figures of the appended drawing will elucidate the manner in which the invention may be embodied. In these figures, identical references designate similar elements.

DETAILED DESCRIPTION OF THE INVENTION

Figure 1:
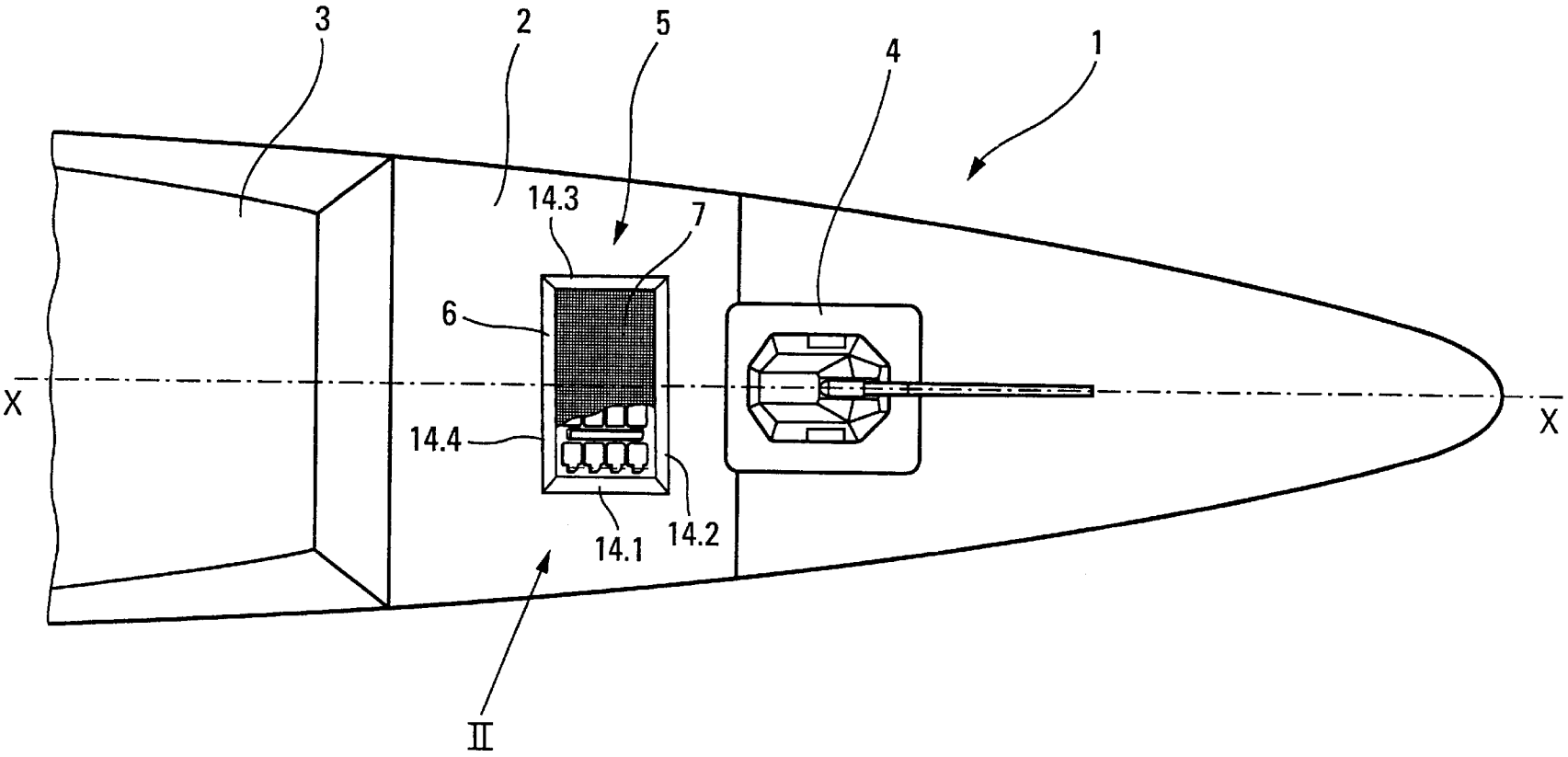
FIG. 1 shows, in a view from above, the bow of a ship equipped with a battery of missiles, protected by the antidetection device in accordance with the present invention.
Figure 2:
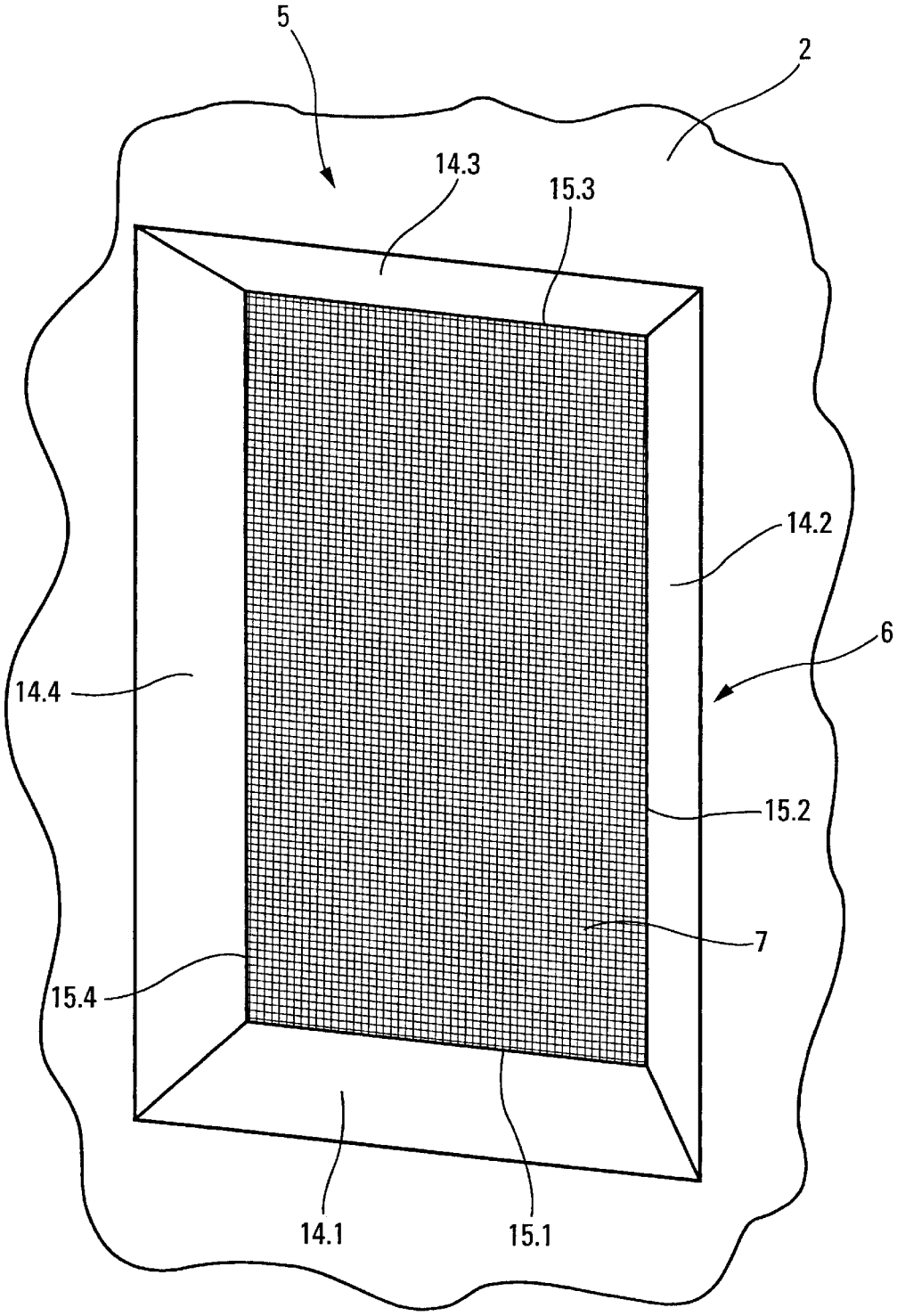
FIG. 2 is a perspective view from above, according to the arrow II of FIG. 1, of the antidetection device of this latter figure.

The ship 1, of longitudinal axis X—X, only the bow of which is represented in FIG. 1, comprises a deck 2 and bridge 3, as well as a fore artillery turret 4. Between the bridge 3 and the turret 4 is provided a battery of missiles 5, surrounded by a frame 6 and covered by a net 7 (partly cut away in FIG. 1). The frame 6 and the net 7 are represented on a larger scale in the perspective view of FIG. 2.

Figure 4:
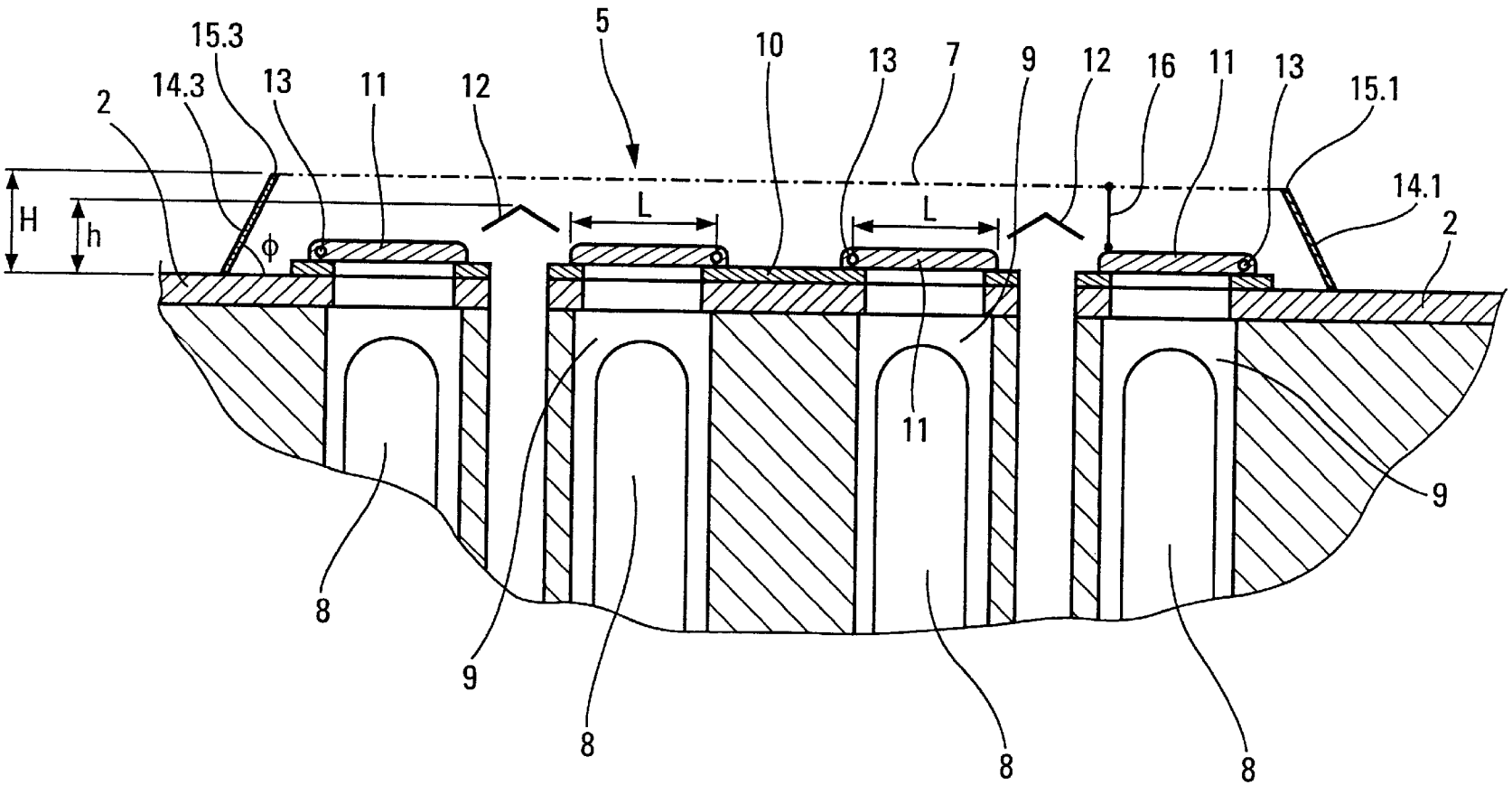
FIGS. 4 and 5 are diagrammatic sectional views respectively along the lines IV—IV and V—V of FIG. 3.
Figure 5:
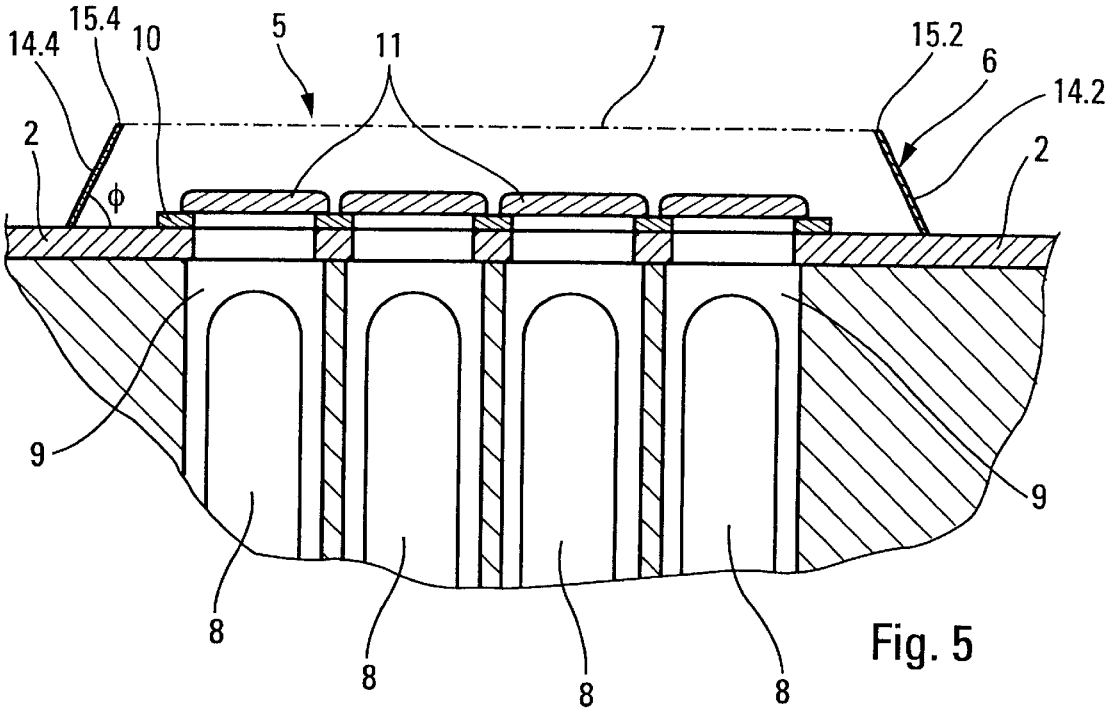

As may be seen in the cross sections of FIGS. 4 and 5, the battery of missiles 5, on board the ship, comprises a plurality of missiles 8, contained in vertical shafts 9 disposed under the deck 2.

Outside of the firing sequences, the superstructure of the battery of missiles 5, located above the deck 2, is composed essentially of a baseplate 10 and a plurality of closed doors 11 each of which occludes the upper part of a shaft 9 and of ducts 12, intended for discharging the combustion gases from the motors (not represented) of the missiles 8 during firing. Each door 11 is articulated in rotation on the baseplate 10 about an axle 13.

Figure 3:
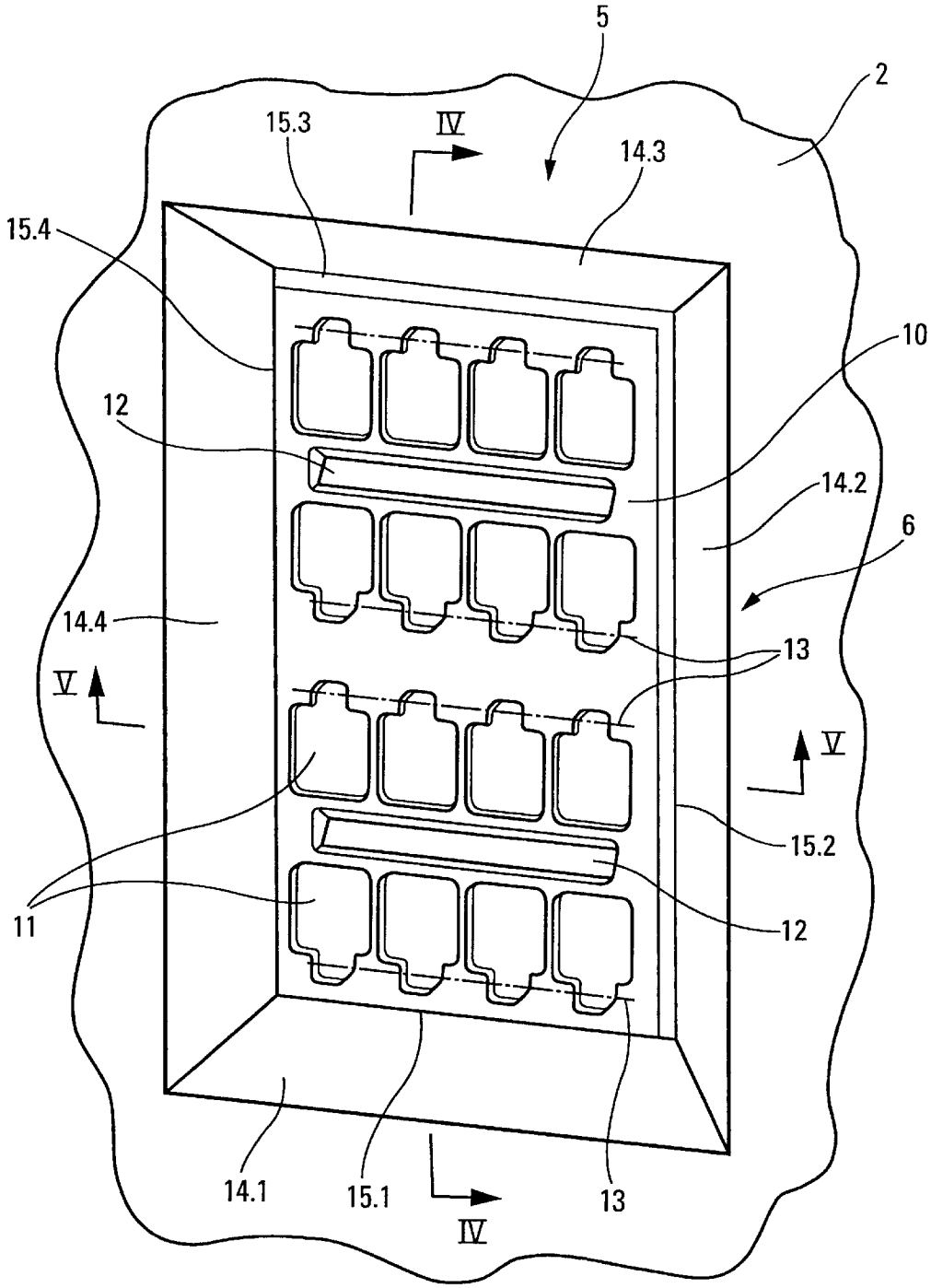
FIG. 3 is a diagrammatic view of said antidetection device similar to that of FIG. 2, the stealthy protective net being assumed to have been removed.

In the exemplary embodiment represented in FIGS. 1 to 8, the frame 6 consists of four inclined plane faces 14.1 to 14.4 forming a truncated pyramid with a rectangular base, projecting with respect to the deck 2. The height H of the frame 6 above the deck 2 is greater than the corresponding height h of the superstructure 10, 11 and 12 (the doors 11 being closed, as represented in FIGS. 3, 4, 5). The frame 6 is fixed to the deck 2 and/or to the baseplate 10, by its large base with the aid of any known means (not represented). Additionally, the length L of the doors 11 is greater than the height H of the frame 6.

Each face 14.1 to 14.4, for example made of steel, is capable of reflecting electromagnetic waves and forms a plane screen projecting with respect to the deck 2, while forming an angle Φ therewith. The inclination Φ of the plane screens 14.1 to 14.4 is such that each of them gets closer to the superstructure 10, 11 and 12 (and hence to the other screens so as to form the small base of the pyramidal frustum) as it gets further from the deck 2.

As may be seen in FIG. 1, the frusto-pyramidal frame 6 is disposed in such a way that the inclined plane screens 14.1 and 14.3 are disposed respectively to starboard and to port, while the inclined plane screens 14.2 and 14.4 are transverse.

The small base of the frusto-pyramidal frame 6, which base is formed by the free edges 15.1 to 15.4, opposite the deck 2, of the inclined plane screens 14.1 to 14.4, is occluded by the net 7 fixed and stretched on said free edges in any known manner (not represented). The net 7, whose height above the deck 2 is therefore substantially equal to the height H of the frame 6, is metallic and is able to reflect electromagnetic waves.

Figure 6:
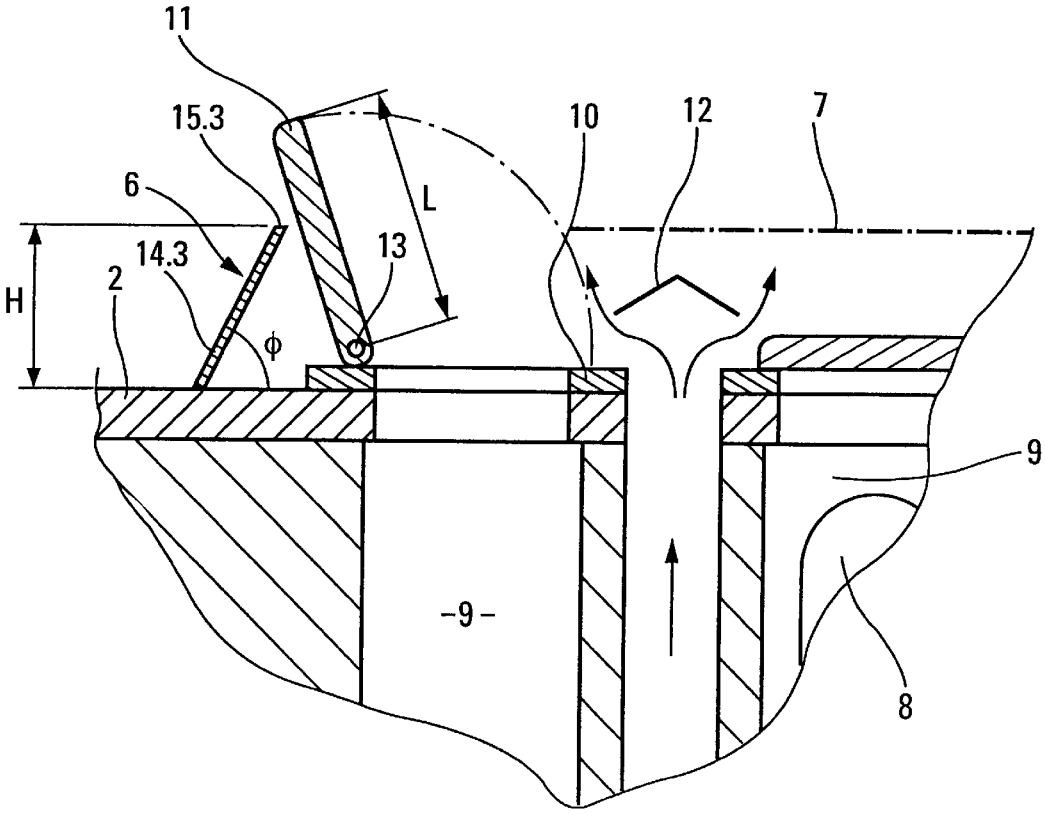
FIG. 6 diagrammatically illustrates the opening of a door of shafts of the battery of missiles, causing the ripping of said stealthy protective net.

The net 7 exhibits mechanical strength which is great enough to be self-bearing, yet low enough to be able to be torn partially by a door 11 passing to the open position, as is illustrated diagrammatically in FIG. 6.

Thus, when a missile 8 is to be fired, the corresponding door 11 is opened, thereby making it possible to rip the net 7 locally opposite the corresponding shaft 9, since the length L of said door 11 is greater than the height H of the net 7. The missile is fired and it passes through the rip in the net 7, while the combustion gases from the motor of the missile are exhausted through the associated duct 12, as is illustrated diagrammatically by arrows in FIG. 6.

Figure 7:
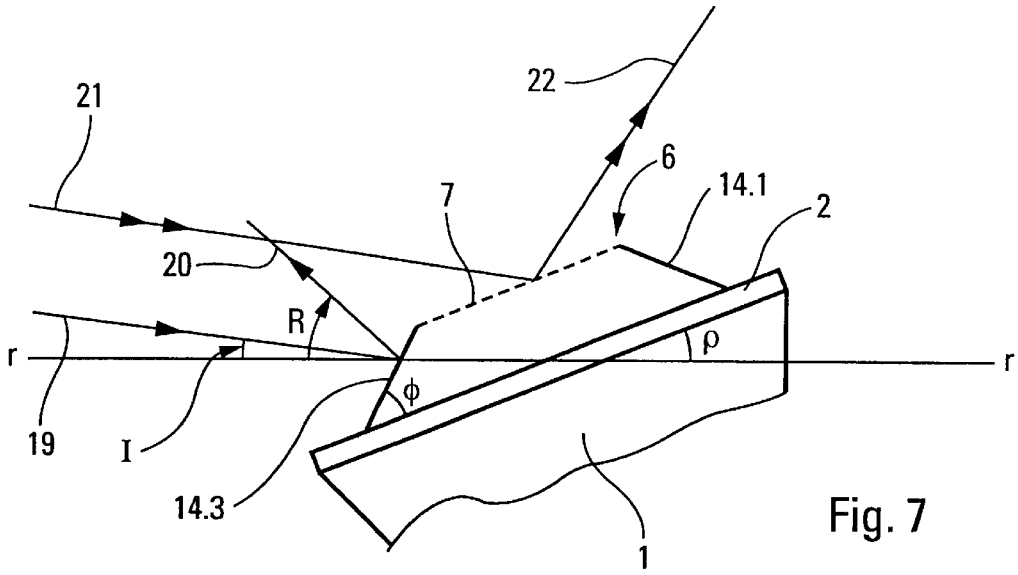
FIG. 7 is a diagram illustrating the operation of said antidetection device.

Represented diagrammatically in FIG. 7 are the deck 2 of the ship 1 and a horizontal reference plane r—r.

With respect to this horizontal reference plane r—r, have been indicated moreover:

- the angle I of incidence of a lateral beam of electromagnetic waves 19 striking the inclined plane screen 14.3;
- the angle R of reflection of the corresponding reflected beam of electromagnetic waves 20; and
- the angle of roll ρ of the ship 1 about its X—X axis.

Additionally, Φ designates the angle of inclination of the plane screens 14.1 to 14.4 with respect to the deck 2.

It will be readily verified that the above quantities are connected by the relation:

$$R = 2\left[\left(\frac{\Pi}{2} - \Phi\right) - \rho\right] - I \tag{1}$$

To allow for the main lobe from the backscattering of the superstructure and to dispense therewith, it is appropriate to deduct from the angle R, determined by relation (1), the value of 3/2 times the three-dB width LP of the main backscattering lobe of the plane screen 14.3. Expression (1) then becomes:

$$R = 2\left[\left(\frac{\Pi}{2} - \Phi\right) - \rho\right] - I - \frac{3}{2}LP \tag{2}$$

Figure 8:
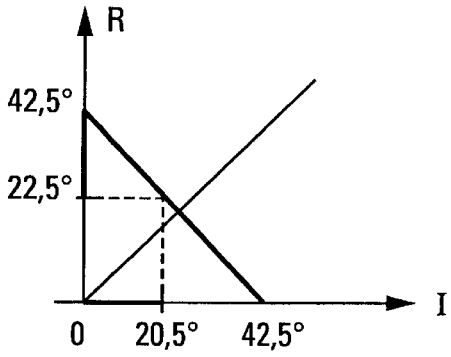
FIG. 8 is a chart illustrating the variation in the angle of reflection of an incident beam of electromagnetic waves as a function of the angle of incidence of this beam.

In an exemplary embodiment in which the angle of inclination Φ is chosen equal to 60°, the maximum roll ρ of the ship 1 being 5° and the three-dB width LP being equal to 5°, the angle of reflection R is expressed by:

$$R = 42.5° - I \tag{3}$$

as is illustrated in the chart of FIG. 8.

Expression (3) demonstrates clearly that, as the angle of incidence I increases, the angle of reflection R decreases. However, in order for the reflected beam 20 not to return to the radar emitting the incident beam 19, that is to say in order for the frame 6 to be stealthy in respect of this radar, it is necessary for the angle of reflection R to remain always greater than the angle of incidence I, by a minimum safety margin.

Thus, as represented in the chart of FIG. 8, if the angle of incidence I lies between 0° and 20°, the angle of reflection R remains greater than 22.5°, thereby ensuring a minimum safety margin of 2.5°.

It is thus seen that with an angle of inclination Φ equal to 60°, the superstructure 10, 11, 12 is insusceptible in respect of the incident beam 19, up to angles of incidence I of 20°.

If it is desirable for the insusceptibility to be maintained in respect of angles of incidence I greater than 20°, it is then necessary to reduce the angle of inclination Φ, in accordance with the relation (2).

In order to be stealthy, it is known that the metal net 7 must exhibit cells whose largest dimension must be less than the minimum semi-wavelength of the frequency band of the detection radar. Usually, this frequency band is delimited by the extreme values 2 and 18 GHz. It is therefore readily deduced from this that the largest dimension of the cells must be at most equal to 8 mm.

Figure 9:
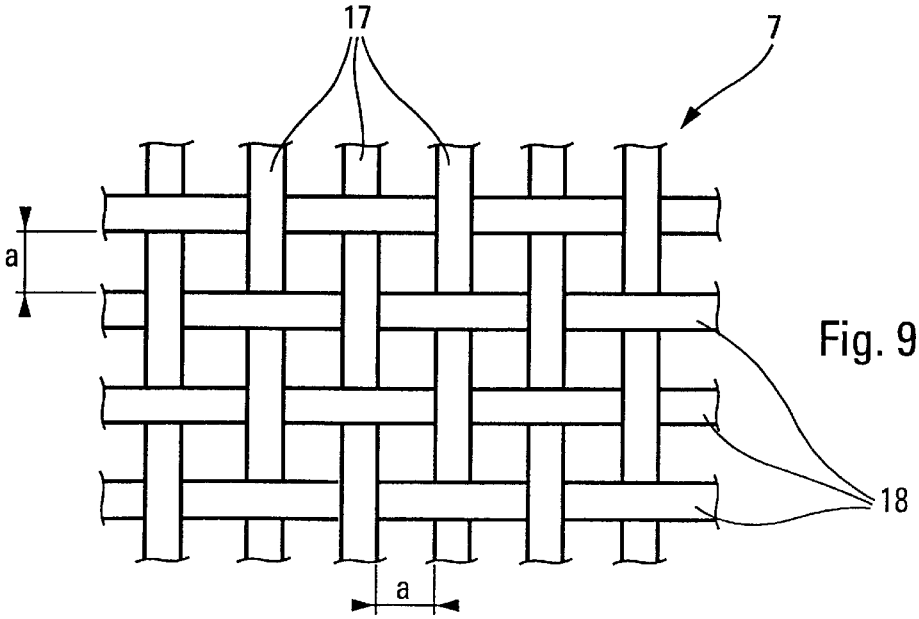
FIG. 9 is a partial enlarged view of an exemplary embodiment of the stealthy protective net of the device of the invention.

Represented in FIG. 9 is an exemplary embodiment of a square-celled net 7 formed of warp wires 17 and of perpendicular weft wires 18. Of course, the dimension a of the sides of the square cells is at most equal to 8 mm, as mentioned hereinabove.

The diameter of the steel wires 17 and 18 constituting the net 7 can be of the order of 3 to 4 mm, so as to ensure a certain amount of mechanical resistance (so as to withstand wind and heavy seas), without however this net 7 being too sturdy, since it must rip under the action of the doors 11 passing into the open position.

Optionally, to facilitate the tearing of the net 7 by the doors 11, it is possible to provide rigid braces 16 between said net and said doors, as is represented in FIG. 4.

Illustrated moreover in FIG. 7 is a lateral incident beam of electromagnetic waves 21 striking the net 7 and reflected along the beam 22 by the latter. It may be observed that this reflected beam 22 can in no case return to the lateral detection radar which emitted the incident beam 21.

What is claimed is:

1. A device enabling a flattened superstructure carried by a deck of a ship to be rendered insusceptible to electromagnetic waves, in particular a superstructure of an idle battery of missiles onboard said ship and said missiles of which are contained in vertical shafts disposed partially under the deck of said ship and occluded at their upper part by swiveling doors which, in a closed position, constitute said superstructure at least in part, said device comprising:

at least on each of the port and starboard sides of said superstructure at least one inclined plane screen able to reflect an incident beam of electromagnetic waves in a different direction from that of said incident beam, said screens projecting with respect to said deck by a height greater than a height of said superstructure and an inclination of said screens being such that they get closer to said superstructure as they get further from said deck, and a net reflecting the electromagnetic waves and stretched above said superstructure.

2. The device as claimed in claim 1, wherein said net is stretched between free edges, away from said deck, of said inclined plane screens.

3. The device as claimed in claim 2, which comprises, in addition to said port and starboard inclined plane screens, other additional similar inclined plane screens forming, with said port and starboard screens, a polyhedron surrounding said superstructure, and in which device said net is stretched between free edges of all said inclined plane screens.

4. The device as claimed in claim 3, which comprises four inclined plane screens forming a frusto-pyramidal tetrahedron surrounding said superstructure.

5. The device as claimed in claim 2, wherein said height of the inclined plane screens and of said net is less than a length of said swiveling occluding doors and wherein said net can be ripped by each of said doors passing from the closed position to an open position.

6. The device as claimed in claim 1, wherein an angle of inclination of said inclined plane screens with respect to said deck is at most equal to 60°.

7. The device as claimed in claim 1, wherein the largest dimension of the cells of said net is at most equal to 0.8 cm.

8. The device as claimed in claim 7, wherein the cells of said net are square with sides at most equal to 0.8 cm.

9. The device as claimed in claim 1, wherein said net comprises criss-crossed steel wires having diameters at most equal to 0.4 cm.

* * * * *